US006666934B2

(12) United States Patent
Helmy et al.

(10) Patent No.: US 6,666,934 B2
(45) Date of Patent: Dec. 23, 2003

(54) EXTRUDED HYDROXY TERMINATED POLYBUTADIENE GAS GENERATING MATERIAL

(75) Inventors: Abdelkader M. Helmy, Sparks, NV (US); William P. Sampson, Sparks, NV (US)

(73) Assignee: TRW Inc., Lyndhurst, OH (US)

( * ) Notice: Subject to any disclaimer, the term of this patent is extended or adjusted under 35 U.S.C. 154(b) by 222 days.

(21) Appl. No.: 09/885,477

(22) Filed: Jun. 20, 2001

(65) Prior Publication Data

US 2003/0037850 A1 Feb. 27, 2003

(51) Int. Cl.[7] ..... C06B 45/10
(52) U.S. Cl. ..... 149/19.4; 149/45
(58) Field of Search ..... 149/19.4, 45

(56) References Cited

U.S. PATENT DOCUMENTS 4,057,441 A * 11/1977 Biddle ..... 149/19.9
4,427,468 A 1/1984 Duchesne et al.
5,472,532 A * 12/1995 Wallace, II ..... 149/17.4
5,610,444 A 3/1997 Austruy et al.
5,979,936 A * 11/1999 Moore et al. ..... 280/736
6,036,894 A 3/2000 Brown et al.

FOREIGN PATENT DOCUMENTS

GB 1 560 981 2/1980
WO WO 99/18051 4/1999

* cited by examiner

*Primary Examiner*—John R. Hardee
(74) *Attorney, Agent, or Firm*—Tarolli, Sundheim, Covell & Tummino L.L.P.

(57) ABSTRACT

A gas generating material (52) for use in a vehicle occupant protection apparatus (10) comprises a particulate oxidizer, a hydroxy terminated polybutadiene, a diisocyanate cross-linking agent, and a plasticizer. The diisocyanate cross-linking agent cross-links the hydroxy terminated polybutadiene to form an elastomeric binder that contains the particulate oxidizer. The ratio of hydroxyl groups of the hydroxy terminated polybutadiene to isocyanate groups of the diisocyanate cross-linking agent is at least about 0.95.

24 Claims, 1 Drawing Sheet

EXTRUDED HYDROXY TERMINATED POLYBUTADIENE GAS GENERATING MATERIAL

FIELD OF THE INVENTION

The present invention relates to a gas generating material. The gas generating material is particularly useful for inflating a vehicle occupant protection device.

BACKGROUND OF THE INVENTION

An inflatable vehicle occupant protection device, such as an air bag, is inflated by gas provided by an inflator. The inflator contains a body of ignitable gas generating material. The inflator further includes an igniter. The igniter is actuated so as to ignite the body of gas generating material when the vehicle experiences a collision for which inflation of the air bag is desired. As the body of gas generating material burns, it generates a volume of inflation gas. The inflation gas is directed into the vehicle air bag to inflate the air bag. When the air bag is inflated, it expands into the vehicle occupant compartment and helps to protect the vehicle occupant.

A convenient way of making a gas generating material is by extrusion. A gas generating material that is extruded can be configured into a variety of shapes, including rods, channels, and other structural shapes suitable for use in various types of inflators. Most current gas generating materials that are extruded tend to burn very hot (i.e., greater than about 3000K) and emit significant amounts of particulate exhaust.

U.S. Pat. No. 6,036,894 discloses a process for manufacturing a composite propellant containing a rubber binder and particulate non-binder ingredients. The process includes curing a hydroxy terminated polybutadiene having a molecular weight of 3000 and a functionality of 2.2 with an isophorone diisocyanate cross-linking agent.

SUMMARY OF THE INVENTION

The present invention is a gas generating material for use in a vehicle occupant protection apparatus. The gas generating material comprises a particulate oxidizer, a hydroxy terminated polybutadiene, a diisocyanate cross-linking agent, and a plasticizer. The diisocyanate cross-linking agent cross-links the hydroxy terminated polybutadiene to form an elastomeric binder that contains the particulate oxidizer. The ratio of hydroxyl groups of the hydroxy terminated polybutadiene to isocyanate groups of the diisocyanate cross-linking agent is at least about 0.95.

BRIEF DESCRIPTION OF THE DRAWINGS

Further features of the present invention will become apparent to those skilled in the art to which the present invention relates from reading the following description with reference to the accompanying drawings, in which.

DESCRIPTION OF PREFERRED EMBODIMENT

Figure 1:
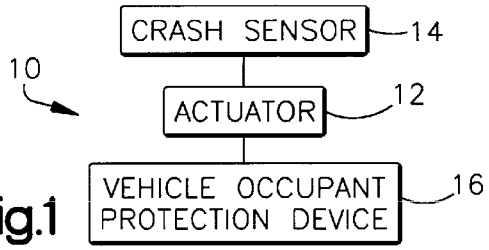
FIG. 1 is a schematic view of a vehicle occupant protection apparatus including an inflator constructed in accordance with the present invention.

As representative of the present invention, FIG. 1 illustrates schematically a vehicle occupant protection apparatus

10. The vehicle occupant protection apparatus 10 includes a vehicle occupant protection device 16. In one embodiment of the present invention, the vehicle occupant protection device 16 is an air bag. Other vehicle occupant protection devices that can be used in accordance with the present invention are, for example, an inflatable seat belt, an inflatable knee bolster, an inflatable head liner, an inflatable side curtain, a knee bolster operated by an air bag, and a seat belt actuated by a seat belt pretensioner.

An actuator 12 is associated with the vehicle occupant protection device 16. The actuator 12 is actuatable to generate combustion gas to actuate the vehicle occupant protection device 16.

The apparatus 10 also includes a crash sensor 14. The crash sensor 14 is a known device that senses a vehicle condition, such as vehicle deceleration, indicative of a collision or rollover. If the sensed vehicle condition is one for which actuation of the vehicle occupant protection device is desired, the crash sensor 14 either transmits a signal or causes a signal to be transmitted to the actuator 12. The vehicle occupant protection device 16 is then actuated to help protect a vehicle occupant from a forceful impact with parts of the vehicle.

In one embodiment of the present invention, the actuator is a pyrotechnic inflator for producing gas to inflate an air bag. The actuator, however, could be a gas generator for a seat belt pretensioner (not shown), or a hybrid air bag inflator (not shown).

Figure 2:
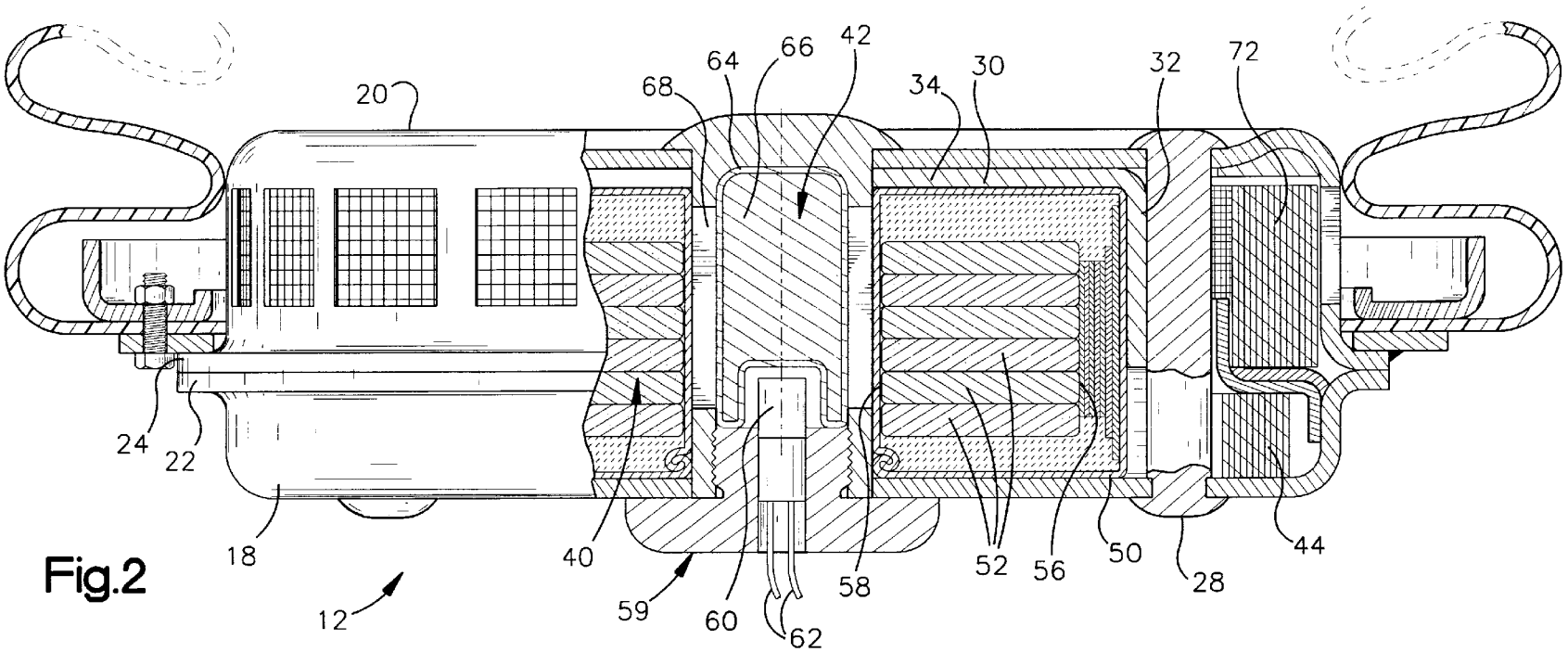
FIG. 2 is an enlarged, sectional view showing the inflator of FIG. 1.

The specific structure of the inflator could vary. Referring to FIG. 2, the inflator 12 comprises a base section 18 and a diffuser section 20. The two sections 18 and 20 are joined together at mounting flanges, 22 and 24. Mounting flanges 22 and 24 are attached to each other by a continuous weld. A plurality of rivets 28 also hold the diffuser section 20 and the base section 18 together.

A combustion cup 30 is seated between the diffuser section 20 and the base section 18. The combustion cup 30 comprises an outer cylindrical wall 32 and an annular top wall 34. The combustion cup 30 divides the inflator 12 into a combustion chamber 40 that is located within the combustion cup 30 and a filtration chamber 44 that is annular in shape and is located outside the combustion cup 30. The combustion chamber 40 houses an inner container 50 that is hermetically sealed. The inner container 50 holds a gas generating material 52 that is in the form of a plurality of gas generating discs. The gas generating discs have a generally toroidal configuration with a cylindrical exterior surface 56 and an axially extending hole defined by a cylindrical interior surface 58. The discs are positioned in the container 50 in a stacked relationship with the axially extending holes in alignment. This configuration of the discs promotes a uniform combustion of the discs. The discs may contain area increasing features such as axially extending passages (not shown) and slots (not shown). The axially extending passages and slots increase the burn surface area of the gas generating material 52 and enhance the flow of combustion products away from the gas generating material. The gas generating material could alternatively be provided in the form of pellets or tablets.

The gas generating material 52 encircles an ignition chamber 42. The ignition chamber 42 is defined by a two-piece, tubular igniter housing 59 that fits within the combustion cup 30 and contains a squib 60. The squib 60 contains a small charge of ignitable material (not shown). Electric leads 62 convey a current to the squib 60. The current is provided when the crash sensor 14, which is responsive to a condition indicative of a vehicle collision, closes an electrical circuit that includes a power source (not shown). The current generates heat in the squib 60, which ignites the ignitable material. The ignition chamber 42 also has a canister 64 that contains a rapidly combustible pyrotechnic material 66, such as boron potassium nitrate. The rapidly combustible pyrotechnic material 66 is ignited by the small charge of ignitable material of the squib 60. The burning pyrotechnic material 66 exits from the ignition chamber 42 through openings 68 in the igniter housing, which lead to the combustion chamber 40. The burning pyrotechnic material 66 penetrates the container 50 and ignites the gas generating discs 53. Other ignition systems capable of igniting the discs 52 are well known and can be used with the present invention.

The inflator 12 also comprises a filter assembly 72 in the filtration chamber 44. The filter assembly 72 is in the flow path between the combustion chamber 40 and the vehicle occupant protection device 16. The filter assembly 72 functions to prevent solid materials produced upon combustion of the gas generating material from entering into the vehicle occupant protection device 16. The filter assembly 72 also cools the combustion products of the gas generating material 52.

The gas generating material 52 of the present invention is a solid composite that is manufactured by a dynamic forming technique, such as extrusion. The solid composite gas generating material includes an oxidizer. The oxidizer can include any oxidizer commonly used in a gas generating material for providing inflation gas for inflating a vehicle occupant protection device.

One preferred oxidizer is ammonium nitrate. Ammonium nitrate is preferred because it produces upon combustion a gas product essentially free of smoke and toxic gases. When ammonium nitrate is used as the oxidizer, the ammonium nitrate is preferably phase stabilized. The phase stabilization of ammonium nitrate is well known. In one method, the ammonium nitrate is doped with a metal cation in an amount that is effective to minimize the volumetric and structural changes associated with phase transitions to pure ammonium nitrate. A preferred phase stabilizer is potassium nitrate. Other useful phase stabilizers include potassium salts, such as potassium dichromate and potassium oxalate. Ammonium nitrate can also be phase stabilized by doping with copper and zinc ions. Other compounds, modifiers, and methods that are effective to phase stabilize ammonium nitrate are well known and suitable in the present invention.

The ammonium nitrate is incorporated in the gas generating material in the form of fine particles. The average particle size of the ammonium nitrate is about 0.5 microns to about 10 microns. Preferably, the average particle size of the ammonium nitrate is about 1 micron to about 10 microns.

Another preferred oxidizer that can be used in the present invention is basic copper nitrate ($Cu(NO_3)_2 \cdot Cu(OH)_2$). Basic copper nitrate readily combusts and produces a combustion product that includes gas and solid material. The moles of gas per gram produced upon combustion of the basic copper nitrate is substantially higher than the moles of gas per gram produced upon combustion of other inorganic oxidizers, such as ammonium perchlorate. Basic copper nitrate has a substantially higher gas yield compared to other inorganic oxidizers because, upon combustion, basic copper nitrate itself yields a gas.

The solid material of the combustion product produced upon combustion of basic copper nitrate includes copper and cuprous oxide. Copper and cuprous oxide readily absorb heat from other combustion products, such as the gas that is produced upon combustion of the basic copper nitrate. Copper and cuprous oxide are also readily filtered from the combustion product. Thus, much of the heat produced upon combustion of the basic copper nitrate remains in the inflator 12 and is not conveyed to the vehicle occupant protection device 16.

The amount of basic copper nitrate in the oxidizer is more than about 50% by weight of the oxidizer. The use of more than about 50% by weight of basic copper nitrate in the oxidizer is effective to reduce substantially the temperature of the combustion gas produced by combustion of the gas generating material. The basic copper nitrate is incorporated in the gas generating material in the form of fine particles. The average particle size of the basic copper nitrate is about 0.5 microns to about 5 microns. Preferably, the average particle size of the basic copper nitrate is about 1 micron to about 2 microns.

When basic copper nitrate is used as an oxidizer, the oxidizer preferably includes a second oxidizer. The second oxidizer is a transition metal oxide. A preferred transition metal oxide is cupric oxide. Cupric oxide, like basic copper nitrate, produces upon combustion copper and cuprous oxide, which can be filtered and which reduce the temperature of the combustion product. Examples of other transition metal oxides that can be used in the gas generating material and that also produce a filterable solid combustion material are iron oxide and molybdenum oxide.

The amount of transition metal oxide in the oxidizer is less than about 50% by weight of the oxidizer. Preferably, the ratio of basic copper nitrate to the transition metal oxide in the oxidizer is from about 1.5:1 to about 4:1. This ratio of basic copper nitrate to transition metal in the oxidizer increases the volume of gas produced upon combustion of the gas generating material, while reducing the production of undesired gaseous species, such as nitrogen oxides. More preferably, the ratio of basic copper nitrate to the transition metal oxide is about 2:1.

The transition metal oxide, like the basic copper nitrate, is incorporated into the gas generating material in the form of fine particles. The average particle size of the transition metal oxide is about 0.5 microns to about 5 microns. Preferably, the average particle size of the transition metal oxide is about 1 micron to about 2 microns.

The oxidizer of the gas generating material can also include a conventional oxidizer, such as an alkali metal nitrate, an alkaline earth metal nitrate, an alkali metal perchlorate, an alkaline earth metal perchlorate, ammonium perchlorate, an alkali metal chlorate, an alkaline earth metal chlorate, a metal oxide, or a mixture thereof. The conventional oxidizer can be used alone or in combination with the ammonium nitrate or the basic copper nitrate and the transition metal oxide. Preferably, the conventional oxidizer is used in small proportions in combination with the ammonium nitrate or the basic copper nitrate and the transition metal oxide. The burn rate of the gas generating material according to the present invention can be controlled over a wide range by the addition of a conventional oxidizer.

When combined with the ammonium nitrate or the basic copper nitrate and the transition metal oxide, the amount of the conventional oxidizer in the oxidizer is preferably up to about 30% by weight of the oxidizer. Preferably, the amount of conventional oxidizer is about 5% to about 20% by weight of the oxidizer. The amount of conventional oxidizer in the oxidizer is limited in order to keep as low as possible the combustion temperatures and to limit the amount of difficult-to-condense residues that are produced upon combustion.

A preferred conventional oxidizer is potassium perchlorate. It is known that a high proportion of potassium perchlorate sharply increases the combustion temperature and releases large quantities of potassium chloride, which is present in the form of a gas under combustion conditions. The amount of potassium perchlorate in the oxidizer is preferably limited to up to 20% by weight of the oxidizer because gaseous potassium chloride cannot readily be removed from the combustion gases by filters. Also, upon condensation, potassium chloride can lead to the undesired formation of smoke in the interior of the vehicle.

The conventional oxidizer is incorporated into the gas generating material in the form of particles. The average particle size of the conventional oxidizer is from about 1 micron to about 100 microns. Preferably, the average particle size of any conventional oxidizer is from about 1 micron to about 20 microns.

The amount of oxidizer in the gas generating material is that amount necessary to oxygen balance the gas generating material so that the gas generating material produces a combustion product essentially free of carbon monoxide. By essentially free of carbon monoxide, it is meant that the amount of carbon monoxide in the combustion gas product is less than 4% by volume of the gas product. An amount of oxidizer necessary to oxygen balance the gas generating material is from about 70% to about 95% by weight of the gas generating material. Preferably, the amount of oxidizer in the gas generating material is about 85% to about 95% by weight of the gas generating material.

The solid composite gas generating material can also include a small amount of an energetic fuel to improve the burn rate and impetus of the gas generating material. Preferred energetic fuels include a nitramine, such as cyclotrimethylenetrinitramine or cyclotetramethylenetetranitramine, an organic nitrate, such as guanidine nitrate, triaminoguanidine nitrate, or tetramethyl ammonium nitrate, an amine metal nitrate complex, such as hexamine cobalt (III) nitrate, and a nitroorganic, such as nitroguanidine or 3-nitro-1,2,4-triazole-5-one, and mixtures thereof. More preferred energetic fuels are guanidine nitrate and hexamine cobalt (III) nitrate.

The energetic fuel is incorporated into the gas generating material in the form of particles. The average particle size of the energetic fuel is from about 1 micron to about 100 microns. Preferably, the average particle size of the energetic fuel is from about 1 micron to about 50 microns.

The amount of energetic fuel incorporated into the solid composite gas generating material of the present invention is 0 to about 20% by weight of the gas generating material. A preferred amount of energetic fuel incorporated into the solid composite gas generating material is about 5% to about 20% by weight of the gas generating material.

The solid composite gas generating material also includes an elastomeric binder that adheres the particles of the oxidizer and particles of energetic fuel, if utilized, into a rigid mass. The elastomeric binder of the present invention comprises a cross-linked hydroxy terminated polybutadiene.

The cross-linked hydroxy terminated polybutadiene is formed by mixing a hydroxy terminated polybutadiene and a diisocyanate cross-linking agent. The diisocyanate cross-linking agent cross-links the hydroxy terminated polybutadiene in a urethane type reaction.

Preferably, hydroxy terminated polybutadiene has an average hydroxyl functionality between about 2 and about 3. More preferably, the hydroxy terminated polybutadiene has a hydroxyl functionality between about 2.4 and about 2.6.

A preferred hydroxy terminated polybutadiene with a hydroxyl functionality between about 2.4 and 2.6. is Poly bd® R-45HTLO. Poly bd® R-45HTLO is commercially available from Atofina Chemical Inc. of Channelview, Tex. and has the general formula:

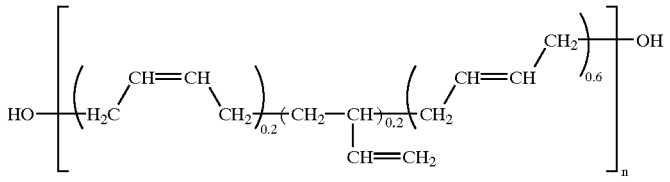

wherein n is about 44 to about 60 and the polybutadiene structure is 60% trans-1,4, 20% cis-1,4, and 20% vinyl-1,2. Poly bd® R-45HTLO is a liquid at room temperature (i.e., about 25° C.). Additionally, Poly bd® R-45HTLO has a viscosity of 5000 mPa-s at 30° C., a hydroxyl value of 0.86 milli-equivalents/gram, and a molecular weight of 2800. The diisocyanate cross-linking agent can be any diisocyanate cross-linking agent commonly used for cross-linking a hydroxy terminated polybutadiene. A preferred diisocyanate cross-linking agent is isophorone diisocyanate. Examples of other diisocyanate cross-linking agents that can be used in the present invention are 2,4-toluene diisocyanate, 1,6-hexamethylene diisocyanate, and 4,4'-methylene bis-phenyl isocyanate.

The amounts of hydroxy terminated polybutadiene and diisocyanate cross-linking mixed together are controlled so that the ratio of isocyanate groups (NCO) of the diisocyanate cross-linking agent to hydroxyl groups (OH) of the hydroxy terminated polybutadiene (i.e., NCO/OH ratio) is at least about 0.95. It has been found that a NCO/OH ratio less than about 0.95 will result in an incomplete reaction of the diisocyanate cross-linking agent with the hydroxy terminated polybutadiene and the formation of an elastomeric binder that is prone to softening and degradation when exposed to temperatures up to about 110° C. Preferably, the NCO/OH ratio is about 0.95 to about 1.3. More preferably, the NCO/OH ratio is about 1.1.

A cross-linking catalyst can be mixed with the hydroxy terminated polybutadiene and the diisocyanate cross-linking agent to accelerate cross-linking of the hydroxy terminated polybutadiene. Preferred cross-linking catalysts include triphenyl bismuth (TPB), dibutyltin dilaurate, and mixtures thereof. The total amount of catalyst mixed with the hydroxy terminated polybutadiene and diisocyanate is preferably about 0.05% to about 0.5% by weight of the elastomeric binder.

The elastomeric binder can also include a plasticizer. The plasticizer can be any plasticizer commonly used in a gas generating material for a vehicle occupant protection apparatus. A preferred plasticizer is dioctyl adipate. Examples of other plasticizers that can be used in the elastomeric binder of the present invention are diethyl hexyl azelate and isodecyl pelargonate.

The amount of plasticizer in the elastomeric binder is that amount of plasticizer effective to prevent the elastomeric binder from becoming brittle and cracking when exposed to temperatures as low as −40° C. An amount of plasticizer effective to prevent the elastomeric binder from becoming brittle is about 1% by weight of the elastomeric binder. Preferably, the amount of plasticizer in the elastomeric binder is about 1% to about 2% by weight of the elastomeric binder. If the elastomeric binder of the present invention includes greater than about 2%, by weight of the elastomeric binder, of plasticizer, the elastomeric binder will not have a sufficient viscosity to allow processing of the gas generating material by dynamic forming techniques.

The elastomeric binder acts as a fuel and preferably comprises at least about 50% by weight of the fuel in the gas generating material. The amount of elastomeric binder in the gas generating material is that amount effective with the energetic fuel, if any, to form an oxygen balanced gas generating material that produces a combustion product essentially free of carbon monoxide. The amount of elastomeric binder in the gas generating material effective to produce a combustion gas that is essentially free of carbon monoxide is about 5% to about 15% by weight of the gas generating material. A preferred amount of elastomeric binder is about 7% to about 13% by weight of the gas generating material.

The elastomeric binder also acts as the working fluid for processing of the gas generating material by dynamic forming techniques, such as extrusion. The volume of working fluid required to process the gas generating material by dynamic forming techniques is at least about 25% by volume of the gas generating material. Therefore, the volume of binder in the gas generating material is at least about 25% by volume of the gas generating material.

The gas generating material is prepared by adding to a batch mixer the oxidizer and the energetic fuel, if utilized. Equal parts of the hydroxy terminated polybutadiene and a liquid carrier are then added to the batch mixer. The liquid carrier is preferably a solvent that is miscible with the hydroxy terminated polybutadiene but does not dissolve the oxidizer and the energetic fuel. A preferred liquid carrier is ethyl acetate.

The oxidizer, the energetic fuel, the hydroxy terminated polybutadiene, and the liquid carrier are mixed at room temperature (i.e., about 25° C.) until the oxidizer and the energetic fuel are uniformly dispersed in the mixture of hydroxy terminated polybutadiene and the liquid carrier. The cross-linking agent, the plasticizer, and the cross-linking catalysts are then added to the mixture of oxidizer, energetic fuel, hydroxy terminated polybutadiene and liquid carrier. Upon adding the diisocyanate cross-linking agent and the cross-linking catalysts, the hydroxy terminated polybutadiene begins to cross-link.

The mixture is stirred until a viscous slurry is formed. The viscous slurry of gas generating material is then exposed to a vacuum that removes the solvent and entrained gas from the viscous slurry. The removal of the solvent from the viscous slurry results in the formation of a gas generating material that has a dough-like consistency.

The dough-like gas generating material is transferred to a block press. The block press consolidates the dough-like gas generating material into the configuration of a cylindrical rod. The block press could shape the dough-like gas generating material into other configurations, such as rectangular and trapezoidal.

The shaped dough-like gas generating material is transferred to an extruder, such as a ram extruder, a single screw extruder, or a twin screw extruder. The extruder conducts the dough-like gas generating material through a shaping device or die with a predetermined diameter. During extrusion, the extruder is maintained at room temperature (i.e., about 25° C.) to prevent the dough-like gas generating material from becoming too viscous to extrude. The extrudate of gas generating material is cut to desired length. The cut extrudate of gas generating material is transferred to an oven and heated to a temperature of about 80° to about 100° C. Heating the extrudate of gas generating material to a temperature of about 80° C. to about 100° C. completes the cross-linking of the hydroxy terminated polybutadiene. Heating the extrudate also causes the gas generating material to form into a rigid mass that is neither brittle at a temperature of about −40° C. nor capable of losing its shape or configuration at a temperature of about 110° C.

EXAMPLES 1–16

Examples 1–16 illustrate extruded solid composite gas generating materials that include the cross-linked hydroxy terminated polybutadiene (HTPB) of the present invention. The cross-linked hydroxy terminated polybutadiene used in Examples 1–16 consists of, by weight of the cross-linked hydroxy terminated polybutadiene, 88.24% Poly bd® R-45HTLO hydroxy terminated polybutadiene, 9.76% isophorone diisocyanate cross-linking agent, and 2.00% dioctyl adipate. Poly bd® R-45HTLO hydroxy terminated polybutadiene is commercially available from Atofina Chemical Inc. of Channelview, Tex. The ratio of hydroxyl groups of the hydroxy terminated polybutadiene to isocyanate groups of the isophorone diisocyanate cross-linking agent is about 1.1.

During preparation of the gas generating materials of Examples 1–16, triphenyl bismuth and dibutyltin dilaurate cross-linking catalysts were also added to the cross-linked hydroxy terminated polybutadiene to accelerate cross-linking of the cross-linked hydroxy terminated polybutadiene. The amount of triphenyl bismuth added to the elastomeric binder was 0.4 grams of triphenyl bismuth per 100 grams of the elastomeric binder. The amount of dibutyltin dilaurate added to the elastomeric binder was 40 microliters of dibutyltin dilaurate per 100 grams of the elastomeric binder.

Examples 1–4

The compositions, thermochemical properties, and ballistic properties for Examples 1–4 are given in Table 1. The thermochemical properties listed in Table 1 include the flame temperature ($T_{flame}$) in Kelvin (K), the impetus in joules/gram (J/g), the gamma ($C_p/C_v$), the moles of gas produced per 100 grams of gas generating material, the moles of gas produced less the potassium chloride per 100 grams of gas generating material, the moles of carbon monoxide in the combustion gas produced per 100 grams of gas generating material, and the moles of carbon monoxide in the exhaust gas produced per 100 grams of gas generating material. The thermochemical properties were calculated using the U.S. Navy PEP Thermochemical Equilibrium Code.

The ballistic properties listed in Table 1 include the burn rate at a pressure of 30 MPa ($rb_{30MPa}$), the burn rate at a pressure of 40 MPa ($rb_{40MPa}$), and the burn rate at a pressure of 50 MPa ($rb_{50MPa}$). The ballistic properties were calculated using a closed bomb apparatus.

TABLE 1

| | EX 1 | EX 2 | EX 3 | EX 4 |
|---|---|---|---|---|
| Composition, wt. % | | | | |
| BCN | 49.0 | 48.5 | 47.5 | 47.0 |
| CUO | 24.5 | 24.0 | 24.0 | 23.5 |
| KP | 18.0 | 18.0 | 18.0 | 18.0 |
| HTPB | 8.5 | 8.5 | 8.5 | 8.5 |
| GuNi | 0.0 | 1.0 | 2.0 | 3.0 |
| Thermochemical Properties | | | | |
| $T_{flame}$, K | 2109 | 2154 | 2200 | 2240 |
| Impetus, J/g | 322.1 | 335.5 | 348.2 | 361.2 |
| Gamma, $C_p/C_v$ | 1.139 | 1.140 | 1.140 | 1.142 |
| Gas moles/100 g | 1.62 | 1.65 | 1.68 | 1.71 |
| Gas moles/100 g less KCL | 1.53 | 1.56 | 1.58 | 1.62 |
| $CO_C$ Moles/100 g | $5.04 \times 10^{-4}$ | $8.51 \times 10^{-4}$ | $1.60 \times 10^{-3}$ | $3.66 \times 10^{-3}$ |
| $CO_{Ex}$ Moles/100 g | $1.40 \times 10^{-4}$ | $1.40 \times 10^{-4}$ | $1.42 \times 10^{-4}$ | $1.43 \times 10^{-4}$ |
| Ballistic Properties | | | | |
| $rb_{30\ MPa}$, cm/sec | 2.06 | 1.99 | 1.45 | 2.34 |
| $rb_{40\ MPa}$, cm/sec | 2.41 | 2.43 | 1.75 | 2.73 |
| $rb_{50\ MPa}$, cm/sec | 2.50 | 2.75 | 1.98 | 2.82 |

Referring to Table 1, Examples 1–4 show solid composite gas generating materials that include an oxidizer and the cross-linked hydroxy terminated polybutadiene. In each of Examples 1–4, the oxidizer comprises basic copper nitrate, cupric oxide, and potassium perchlorate. In each of the Examples, at least about 50% by weight of the oxidizer is basic copper nitrate, and the ratio of basic copper nitrate to copper oxide is about 2:1. The amount of potassium chlorate in the oxidizer of Examples 1–4 is about 20% by weight of the oxidizer. Examples 2–4 also include a small portion of guanidine nitrate. The gas generating materials in Examples 1–4 are all oxygen balanced to produce a combustion product essentially free of carbon monoxide.

The flame temperatures for the gas generating materials of Examples 1–4 are all below about 2250 K. The impetus, the gamma, the burn rate, and the moles of gas produced of the gas generating materials are effective for actuating a vehicle occupant protection device such as an air bag.

Examples 5–10

The compositions and thermochemical properties for Examples 5–10 are given in Table 2. The thermochemical properties listed in Table 2 include the flame temperature in Kelvin, the impetus in joules/gram, and the moles of gas produced per 100 grams of gas generating material. The thermochemical properties were calculated using the U.S. Navy PEP Thermochemical Equilibrium Code.

TABLE 2

| | EX 5 | EX 6 | EX 7 | EX 8 | EX 9 | EX 10 |
|---|---|---|---|---|---|---|
| Composition, wt. % | | | | | | |
| BCN | 45 | 45 | 45 | 43 | 45 | 47 |
| CUO | 12 | 12 | 10 | 10 | 10 | 10 |
| KP | 12 | 14.5 | 16.5 | 18.5 | 18.5 | 18.5 |

TABLE 2-continued

| | EX 5 | EX 6 | EX 7 | EX 8 | EX 9 | EX 10 |
|---|---|---|---|---|---|---|
| HTPB | 8.5 | 8.5 | 8.5 | 8.5 | 8.5 | 8.5 |
| GuNi | 20 | 20 | 20 | 20 | 18 | 16 |
| $Fe_2O_3$ | 2.5 | 0 | 0 | 0 | 0 | 0 |
| Thermochemical Properties | | | | | | |
| Impetus, J/g | 422.5 | 454.8 | 473.0 | 484.2 | 477.9 | 470.4 |
| $T_{flame}$, K | 1787 | 1914 | 1982 | 2000 | 2024 | 2068 |
| Gas Moles/100 g | 2.42 | 2.44 | 2.45 | 2.48 | 2.42 | 2.34 |

Referring to Table 2, Examples 5–10 show solid composite gas generating materials that include an oxidizer and the cross-linked hydroxy terminated polybutadiene. In each of Examples 1–4, the oxidizer comprises basic copper nitrate, cupric oxide, and potassium perchlorate. In each of the Examples, at least about 50% by weight of the oxidizer is basic copper nitrate, and the ratio of basic copper nitrate to copper oxide is about 4:1. The amount of potassium perchlorate in the oxidizer of Examples ranges from a low of 17% by weight of the oxidizer (Example 5) to a high of 26% by weight of the oxidizer. Examples 5–11 also include a between about 16% and about 20%, by weight of the gas generating material, of guanidine nitrate (Guni). The gas generating materials in Examples 5–11 are all oxygen balanced to produce a combustion product essentially free of carbon monoxide.

The flame temperatures for the gas generating materials of Examples 5–11 are all below about 2100 K. The impetus and moles of gas produced of the gas generating materials are effective for actuating a vehicle occupant protection device such as an air bag.

Examples 11–16

The compositions and thermochemical properties for Examples 11–16 are given in Table 3. The thermochemical properties listed in Table 3 include the flame temperature in Kelvin, the impetus in joules/gram, and the moles of gas produced per 100 grams of gas generating material. The thermochemical properties were calculated using the U.S. Navy PEP Thermochemical Equilibrium Code.

TABLE 3

| | EX 11 | EX 12 | EX 13 | EX 14 | EX 15 | EX 16 |
|---|---|---|---|---|---|---|
| Composition, Wt. % | | | | | | |
| AN | 91.42 | 85.7 | 71.59 | 32.38 | 15.17 | 0 |
| KP | 2.4 | 7.7 | 20.79 | 57.15 | 73.11 | 87.17 |
| HTPB | 6.18 | 6.6 | 7.62 | 10.47 | 11.72 | 12.83 |
| Thermochemical Properties | | | | | | |
| Impetus, J/g | 1001 | 984 | 944 | 816 | 758 | 709 |
| $T_{flame}$, K | 2397 | 2438 | 2547 | 2904 | 3084 | 3266 |
| Gas Moles/100 g | 2.34 | 2.42 | 2.48 | 2.45 | 2.44 | 2.43 |

Referring to Table 3, Examples 11–16 show solid composite gas generating materials that include an oxidizer and the cross-linked hydroxy terminated polybutadiene. In each of Examples 11–15, the oxidizer comprises ammonium nitrate and potassium perchlorate. In Example 16, the oxidizer consists of potassium perchlorate.

Examples 11–16 show the wide variations in flame temperature that can be achieved for the gas generating materials by varying the percentages of the potassium perchlorate in the oxidizer. The flame temperatures of the gas generating materials vary from a low of 2397 K, when a small portion of potassium perchlorate is included in the oxidizer, to a high of 3266 K, when oxidizer consists solely of potassium perchlorate. The impetus and moles of gas produced of the gas generating materials are effective for actuating a vehicle occupant protection device such as an air bag.

From the above description of the invention, those skilled in the art will perceive improvements, changes and modifications. Such improvements, changes and modifications within the skill of the art are intended to be covered by the appended claims.

Having described the invention the following is claimed:

1. A gas generating material for use in a vehicle occupant protection apparatus, said gas generating material comprising a particulate oxidizer, a hydroxy terminated polybutadiene, a diisocyanate cross-linking agent, and a plasticizer, said diisocyanate cross-linking agent cross-linking said hydroxy terminated polybutadiene to form an elastomeric binder that contains said particulate oxidizer, wherein the ratio of isocyanate groups of the diisocyanate cross-linking agent to hydroxyl groups of the hydroxy terminated polybutadiene is at least about 0.95 and wherein more than about 50% by weight of the oxidizer is basic copper nitrate.

2. The gas generating material of claim 1 wherein the hydroxy terminated polybutadiene has a hydroxyl functionality of between about 2.4 and 2.6.

3. The gas generating material of claim 1 wherein the cross-linking agent is isophorone diisocyanate.

4. The gas generating material of claim 1 wherein the ratio of isocyanate groups of the diisocyanate cross-linking agent to hydroxyl groups of the hydroxy terminated polybutadiene is about 0.95 to about 1.3.

5. The gas generating material of claim 1 wherein the elastomeric binder further includes a cross-linking catalyst that accelerates cross-linking of the hydroxy terminated polybutadiene.

6. The gas generating material of claim 5 wherein the cross-linking catalyst is selected from the group consisting of triphenyl bismuth, dibutyltin dilaurate, and mixtures thereof.

7. The gas generating material of claim 1 wherein the amount of plasticizer is about 1% to about 2% by weight of the elastomeric binder.

8. The gas generating material of claim 1 wherein the plasticizer is dioctyl adipate.

9. The gas generating material of claim 1 wherein the elastomeric binder comprises about 5% to about 15%, by weight of the gas generating material.

10. The gas generating material of claim 1 wherein said binder comprises at least about 25% by volume of the gas generating material.

11. The gas generating material of claim 1 wherein the gas generating material is an extruded composite.

12. The gas generating material of claim 1 wherein the binder is a fuel and comprises at least about 50% by weight of the fuel in the gas generating material.

13. The gas generating material of claim 10 wherein the oxidizer further comprises a transition metal oxide.

14. The gas generating material of claim 13 wherein the weight ratio of basic copper nitrate to the transition metal oxide is about 1.5:1 to about 4:1.

15. An extruded solid composite gas generating material for use in a vehicle occupant protection apparatus comprising:

about 70% to about 95%, by weight of the gas generating material, of a particulate oxidizer, wherein more than about 50% by weight of the oxidizer is basic copper nitrate;

0 to about 20%, by weight of the gas generating material, of an energetic fuel; and about 5% to about 15%, by weight of the gas generating material, of an elastomeric binder; said elastomeric binder being formed from a hydroxy terminated polybutadiene, a diisocyanate cross-linking agent that cross-links said hydroxy terminated polybutadiene, and a plasticizer;

wherein the ratio of isocyanate groups of the diisocyanate cross-linking agent to hydroxyl groups of the hydroxy terminated polybutadiene is at least about 0.95; and wherein the amount of plasticizer in the elastomeric binder is about 1% to about 2% by weight of the elastomeric binder.

16. The gas generating material of claim 15 wherein the hydroxy terminated polybutadiene has a hydroxyl functionality of between about 2.4 and 2.6.

17. The gas generating material of claim 15 wherein the cross-linking agent is isophorone diisocyanate.

18. The gas generating material of claim 15 wherein the ratio of hydroxyl groups of isocyanate groups of the diisocyanate cross-linking agent to hydroxyl groups of the hydroxy terminated polybutadiene is about 0.95 to about 1.3.

19. The gas generating material of claim 15 wherein the elastomeric binder further includes a cross-linking catalyst that accelerates cross-linking of the hydroxy terminated polybutadiene.

20. The gas generating material of claim 19 wherein the cross-linking catalyst is selected from the group consisting of triphenyl bismuth, dibutyltin dilaurate, and mixtures thereof.

21. The gas generating material of claim 15 wherein the plasticizer is dioctyl adipate.

22. The gas generating material of claim 1 wherein more than 50% by weight of the oxidizer is basic copper nitrate and wherein said binder comprises at least about 25% by volume of the gas generating material.

23. The gas generating material of claim 22 wherein the oxidizer further comprises a transition metal oxide.

24. The gas generating material of claim 13 wherein the weight ratio of basic copper nitrate to the transition metal oxide is about 1.5:1 to about 4:1.

* * * * *